US012557901B1

(12) United States Patent
Jensen

(10) Patent No.: US 12,557,901 B1
(45) Date of Patent: Feb. 24, 2026

(54) PUSH BROOM

(71) Applicant: Stephen P. Jensen, Silt, CO (US)

(72) Inventor: Stephen P. Jensen, Silt, CO (US)

( * ) Notice: Subject to any disclaimer, the term of this patent is extended or adjusted under 35 U.S.C. 154(b) by 352 days.

(21) Appl. No.: 18/199,928

(22) Filed: May 20, 2023

Related U.S. Application Data

(63) Continuation-in-part of application No. 17/066,561, filed on Oct. 9, 2020, now Pat. No. 11,690,442.

(51) Int. Cl.
*A46B 7/04* (2006.01)
*A46B 15/00* (2006.01)

(52) U.S. Cl.
CPC ..... *A46B 7/046* (2013.01); *A46B 15/0026* (2013.01); *A46B 2200/302* (2013.01)

(58) Field of Classification Search
CPC ..... A46B 15/0026; A46B 2200/302; A46B 15/0055; A47L 13/12
See application file for complete search history.

(56) References Cited

U.S. PATENT DOCUMENTS

| | | | | |
|---|---|---|---|---|
| 2,056,906 | A | 10/1936 | Parkhill | |
| 3,377,641 | A | 4/1968 | McGregor | |
| 4,017,386 | A | 4/1977 | Barry | |
| 5,429,402 | A | 7/1995 | Kennedy | |
| 5,749,613 | A | 5/1998 | Rapp | |
| 5,870,794 | A | 2/1999 | Harpell | |
| 8,602,220 | B1 | 12/2013 | Porter | |
| D782,203 | S * | 3/2017 | Fortier | D4/199 |
| 2012/0279520 | A1 | 11/2012 | Sarris et al. | |
| 2013/0031736 | A1 | 2/2013 | Martin | |

* cited by examiner

*Primary Examiner* — Shay Karls
(74) *Attorney, Agent, or Firm* — Cramer Patent & Design, PLLC.; Aaron R. Cramer

(57) ABSTRACT

A push broom with special features to aid in removal of roofing shingles has a metal nail removal tool which is provided on the broom head that functions much like a claw hammer. A user may slide the tool under a nail head and then lifts up on the handle from a standing position to remove the nail. Secondly, the forward-facing edge of the broom body is lined with magnets. This feature allows for easy pickup of nails, staples, and metal debris from grass, pavement and other areas without having to bend over to pick them up, while ensuring that all metal objects are removed.

16 Claims, 7 Drawing Sheets

PUSH BROOM

RELATED APPLICATIONS

The present invention was first described in and is a continuation in part of U.S. Utility application Ser. No. 17/066,561 filed Oct. 9, 2020, the entire disclosures of which are incorporated herein by reference.

FIELD OF THE INVENTION

The present invention relates to a push broom and more specifically to a push broom used for roofing.

BACKGROUND OF THE INVENTION

Those in the roofing industry can attest to the physical demands of the job, which often involves carrying heavy loads, enduring scorching heat, and working at perilous heights while scaling steep roofs. Any tool or technique that eases the workload or improves the quality of the job is highly valued. One particularly unpleasant aspect of roofing projects is the "tear-off" phase, which involves removing old shingles and ensuring that all nails are eliminated from the roof surface. This typically requires crawling on one's hands and knees with a claw hammer, a task that is universally disliked.

Additionally, it is necessary to retrieve any nails that may have fallen to the ground to prevent potential harm to people or property. Finally, all debris must be collected from the roof and surrounding areas, necessitating the use of three separate tools and a significant amount of time and effort. As a result, there is a pressing need for a more efficient and effective way to manage the various tasks involved in a roofing tear-off. The push broom is a solution that satisfies this requirement.

SUMMARY OF THE INVENTION

The principles of the present invention provide for a broom head having a body having a bottom surface, a top surface, a first end, and a second end, a plurality of bristles coupled to the bottom surface of the body, a handle interface enabling a broom handle adapted to be attached to form a broom, and a plurality of magnets located within the body to collect and retain a plurality of metallic debris. The top surface of the body may include a plate having the handle interface at the first end of the body that wraps around a magnet cover at the second end of the body.

The magnet cover may protect the magnets from becoming contaminated. The magnet cover covers the front surface and the top surface of the body such that the magnets are located beneath the magnet cover. The magnet cover may be sheet metal that becomes magnetized by the magnets located beneath the magnet cover. The magnet cover may be a non-metallic covering that a magnetic field of the magnets passes through. The magnet cover, the plate, the handle interface, the body, or combinations thereof made be fabricated from a single material. The plate, the magnet cover, and the handle interface is a single sheet of metal that is stamped and bent to shape or the body.

The magnets may be embedded into the top surface of the body in a forward position such that the top of the magnets is flush with the top surface of the body and the front of the magnets are flush with the front surface of the body. The magnets may be disposed on either lateral side of the plate. The handle interface may be a threaded female coupler that is operable to mate with a threaded male coupler that is located on the bottom end of the broom handle. The threaded female coupler on the body and the threaded male coupler on the broom handle may include a plurality of complementary threads such that the threaded male coupler on the broom handle threads into the threaded female coupler on the body to retain the body on the broom handle.

The complementary threads may be ¾-5 ACME threads. The plate may be removably affixed to the top surface of the body through an aperture. The plate may include a vertically oriented portion coupled to a front surface of the body. The body may be shaped like a rectangular prism. Each of the bristles may be a semi-rigid filament. Each of the bristles may be of a uniform length such that the bristles simultaneously touch a floor when the body is held in a sweeping orientation.

The sweeping orientation may refer to an orientation of the body such that the bottom surface of the body is parallel to the floor. The handle interface may be oriented at a handle angle towards the rear of the body at an oblique angle measured between the top surface of the body and the broom handle.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
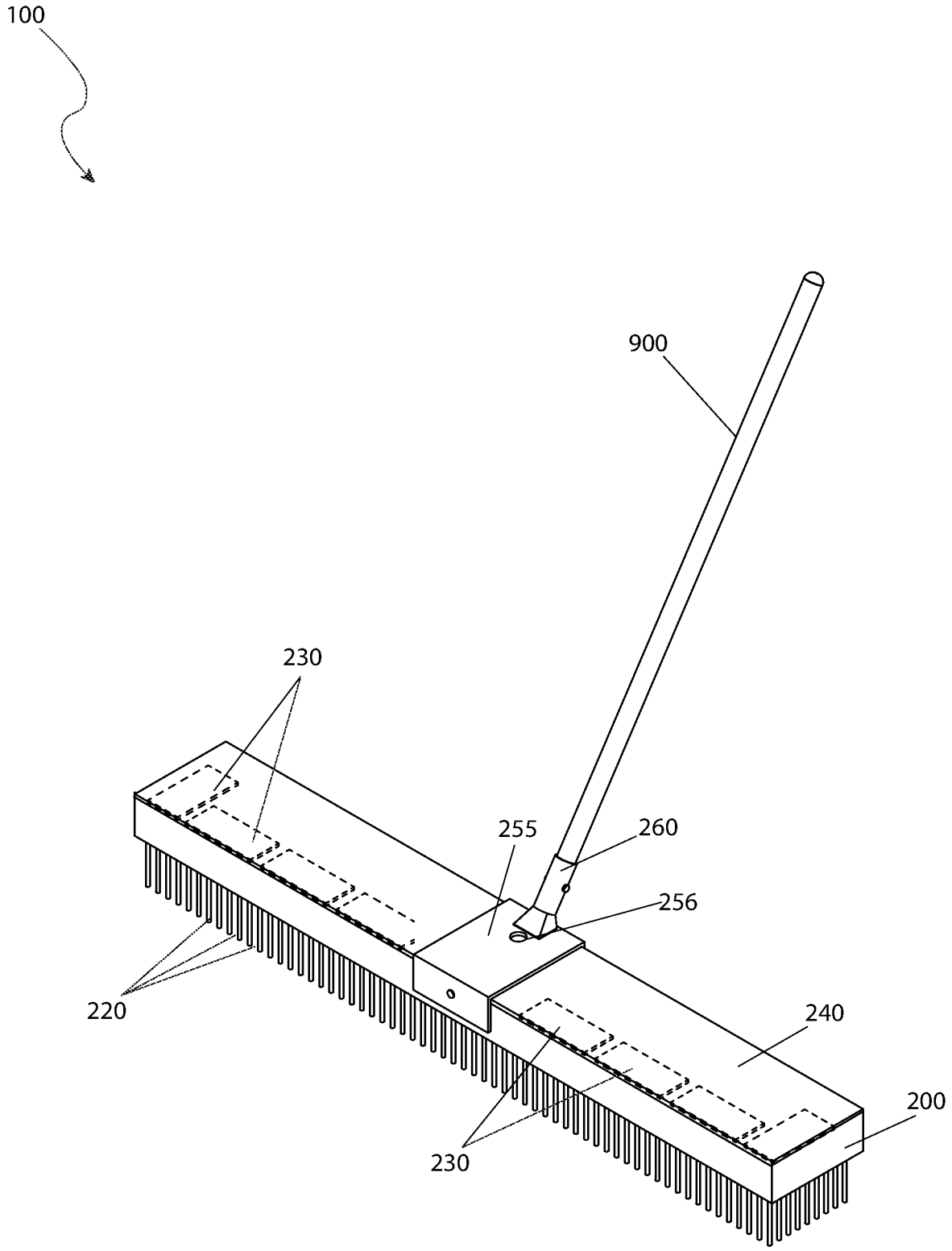
FIG. 1 is a front isometric view of a broom head, according to an embodiment of the present invention.

100 broom head
200 body
202 top surface
204 bottom surface
206 front surface
220 plurality of bristles
228 individual bristle
230 magnet
240 magnet cover
255 plate
256 aperture
260 handle interface
262 threaded female coupler
268 handle angle
270 broom
290 sweeping orientation
900 broom handle
902 threaded male coupler

DESCRIPTION OF THE INVENTION

The present invention is directed to a broom head with nail puller attachment (herein described as the "invention")

Figure 2:
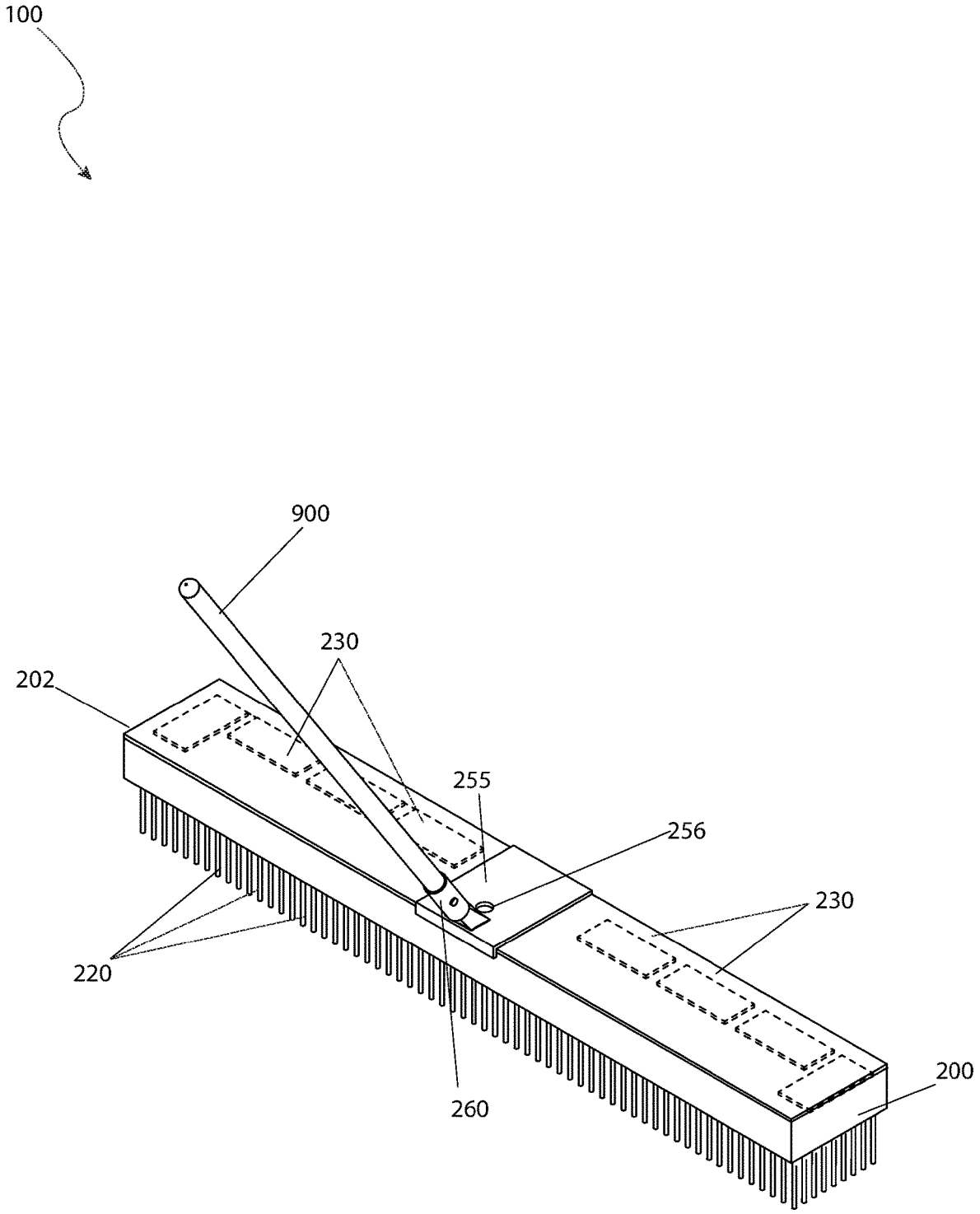
FIG. 2 is a rear isometric view of a broom head, according to an embodiment of the present invention.
Figure 3:
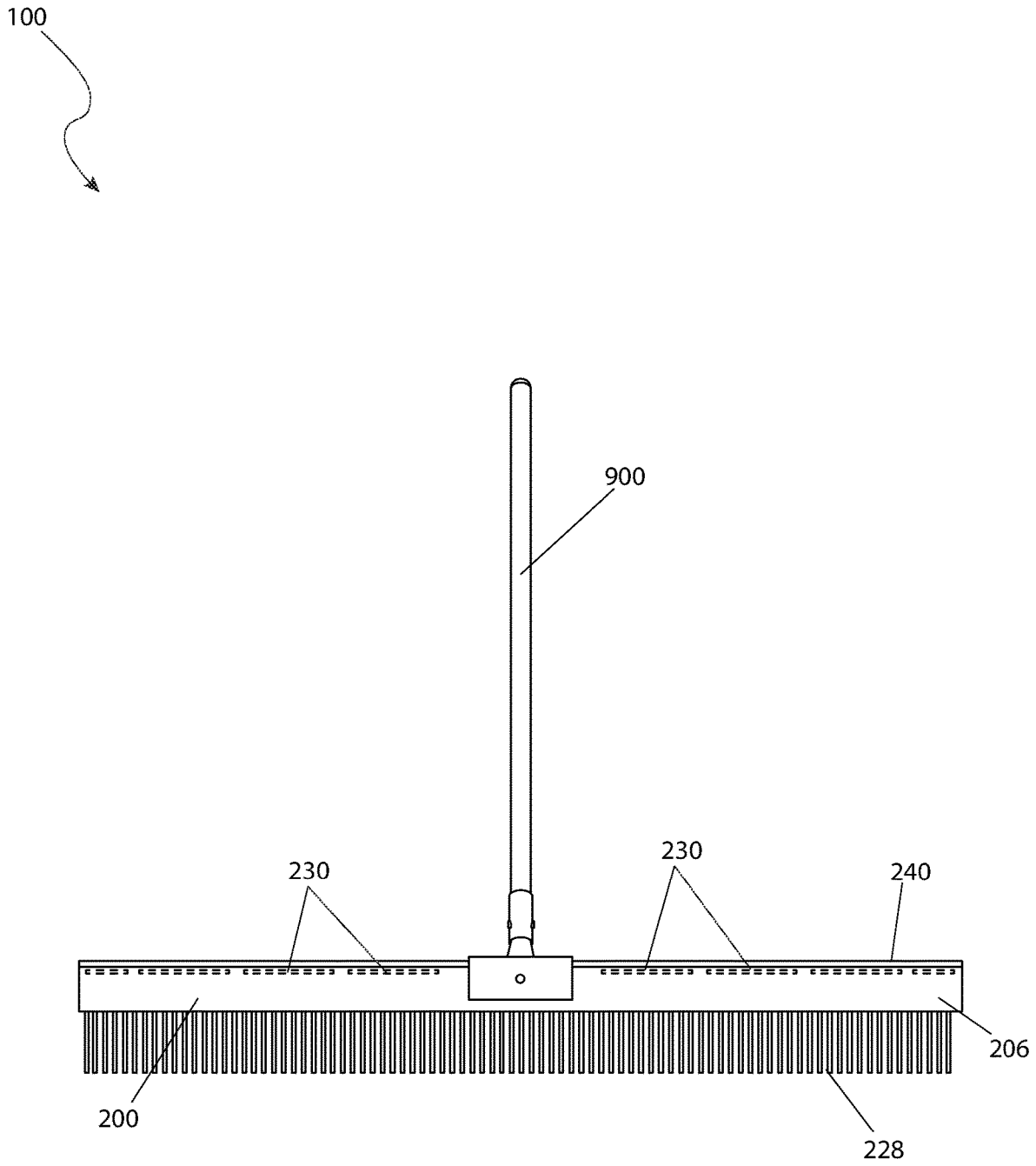
FIG. 3 is a front view of a broom head, according to an embodiment of the present invention.
Figure 4:
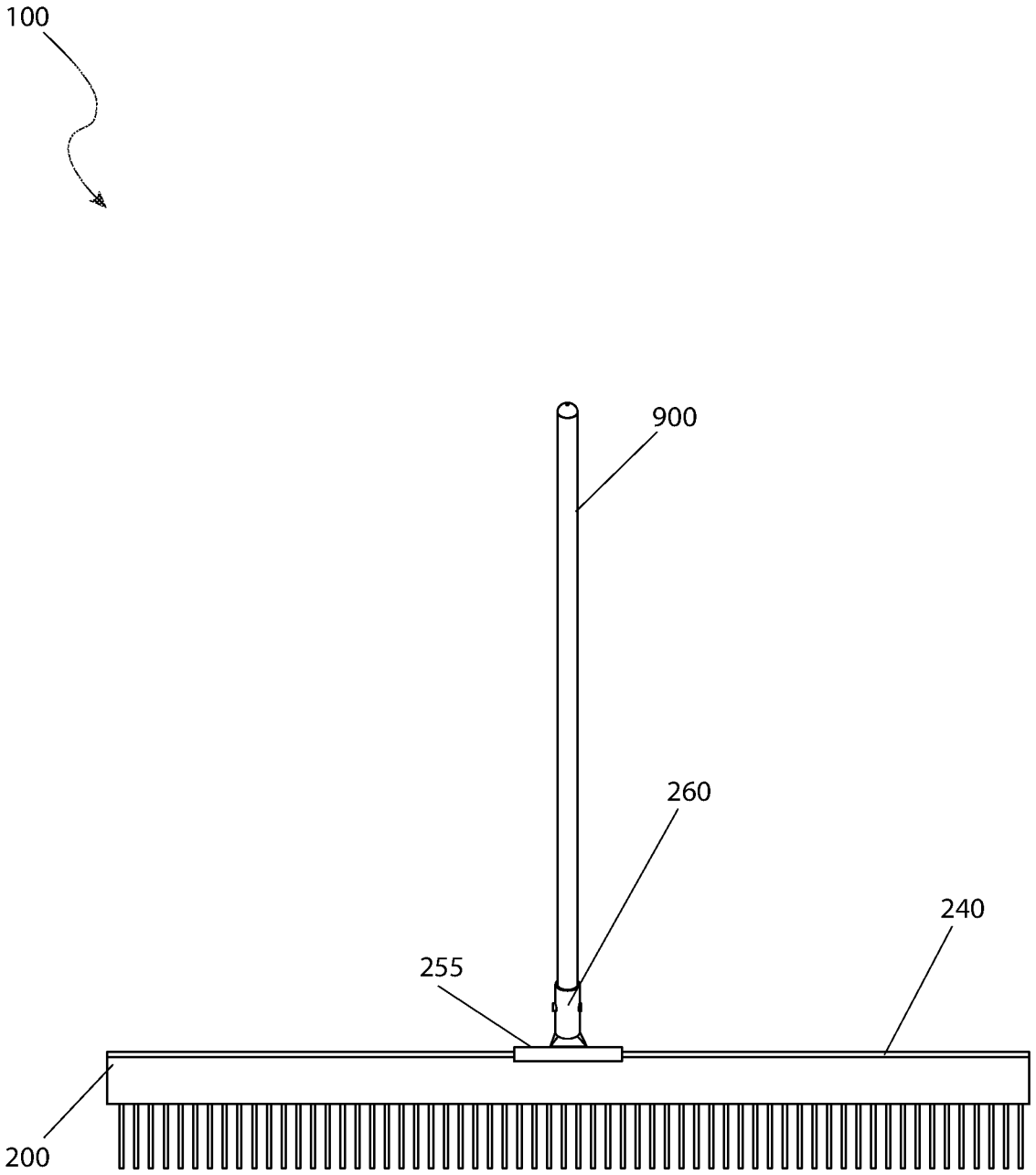
FIG. 4 is a rear view of a broom head, according to an embodiment of the present invention.
Figure 5:
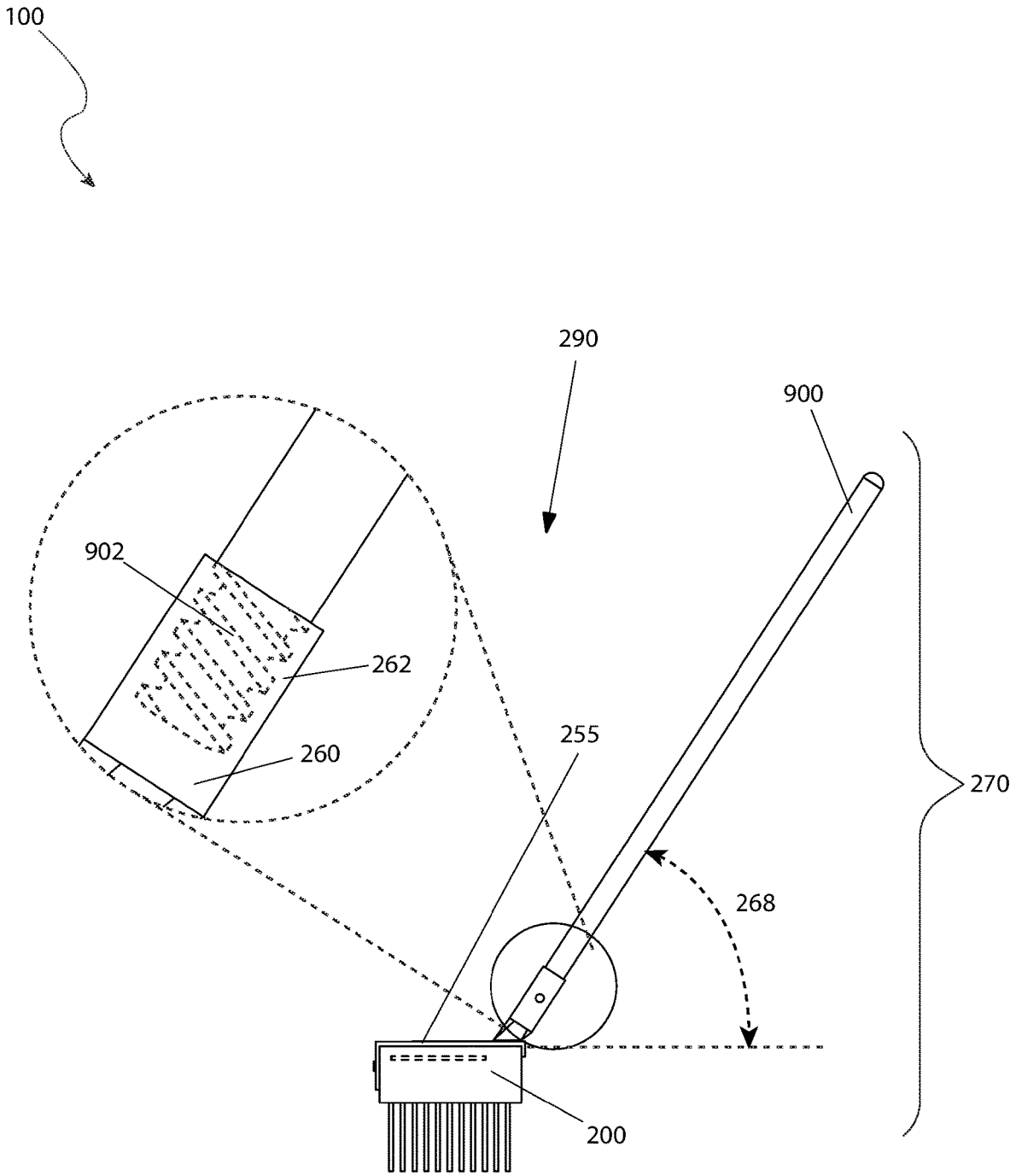
FIG. 5 is a side view of a broom head, according to an embodiment of the present invention.
Figure 6:
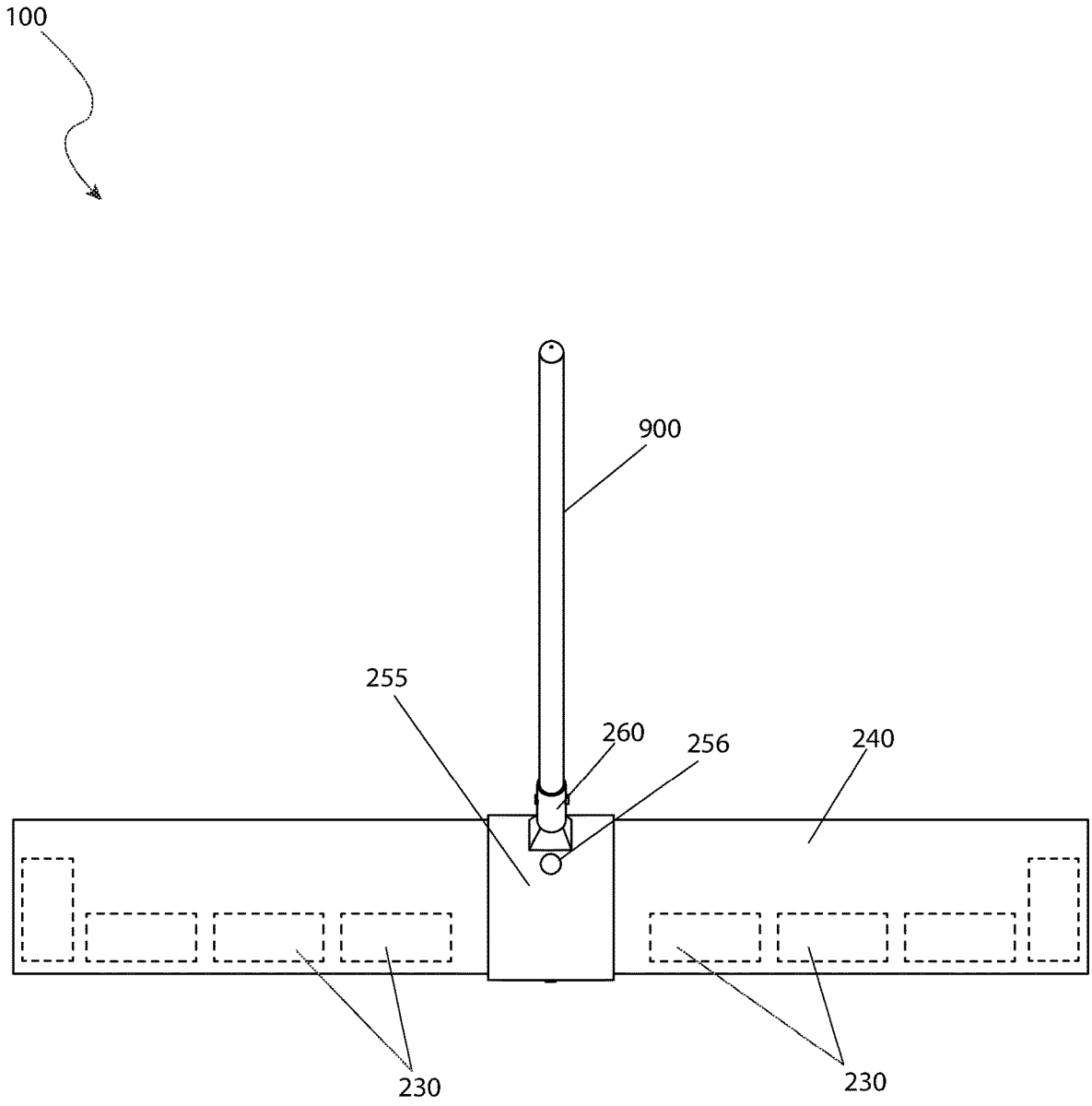
FIG. 6 is a top view of a broom head, according to an embodiment of the present invention.
Figure 7:
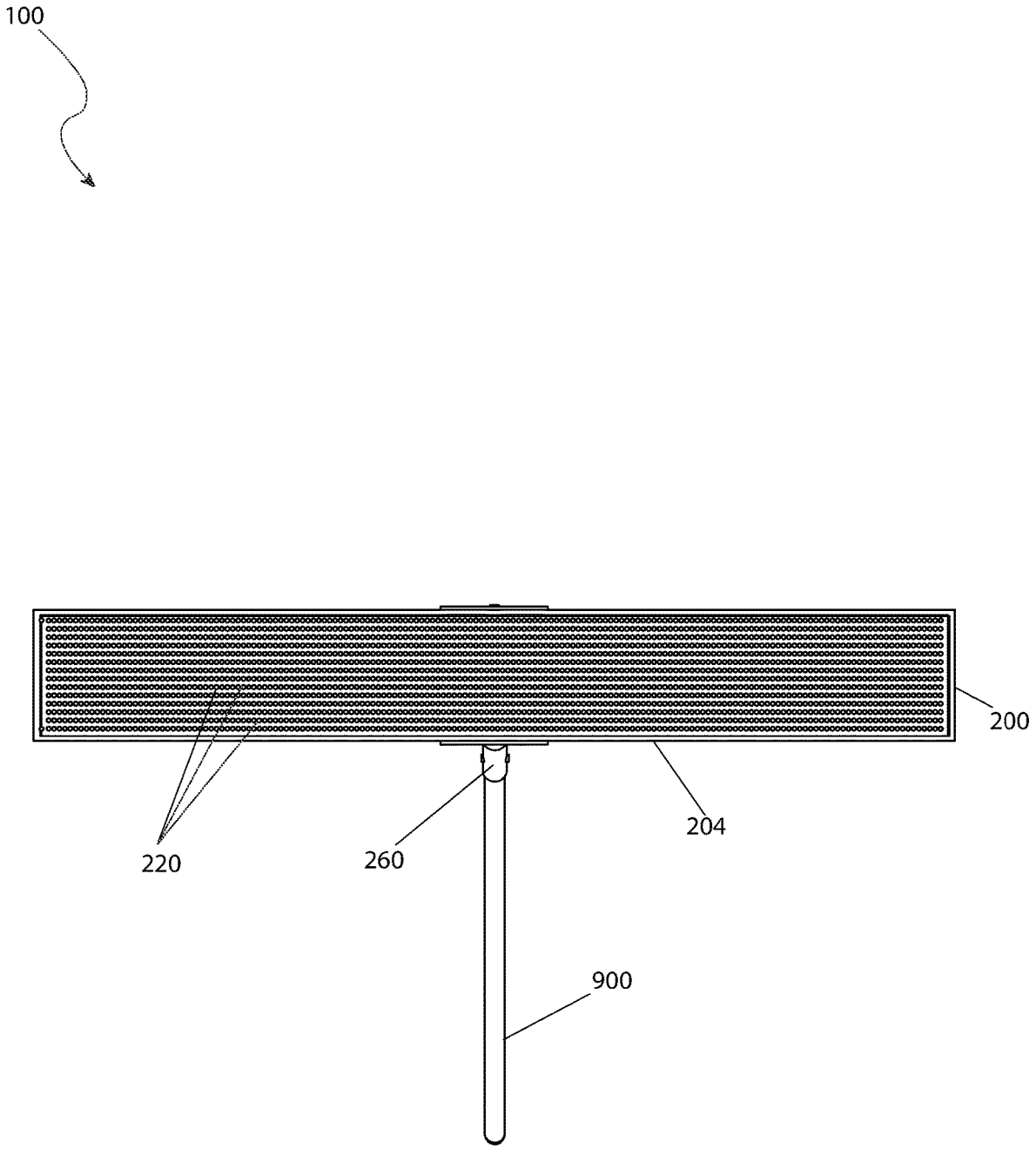
FIG. 7 is a bottom view of a broom head, according to an embodiment of the present invention.

100 (FIGS. 1-7). The invention may comprise a body 200, a plurality of bristles 220, a handle interface 260, and a plurality of magnets 230. The invention 100 may removably couple to a broom handle 900 to form a broom 270. The broom 270 may be operable to sweep a floor when placed into a sweeping orientation 290 and pushed along the floor. The handle interface 260 enables a broom handle 900 to be attached thereto. The plurality of magnets 230 located within the body 200 may be operable to collect and retain the nails or other metallic debris.

Throughout this document terminology related to positions, directions, and orientations assume that the invention 100 is oriented for sweeping with the plurality of bristles 220 resting on the floor unless stated otherwise.

A bottom surface 204 of the body 200 may be coupled to the plurality of bristles 220. An individual bristle 228 may be a semi-rigid filament. The plurality of bristles 220 on the body 200 may be of uniform length such that the plurality of bristles 220 simultaneously touch the floor when the body 200 is held in the sweeping orientation 290. The sweeping orientation 290 may refer to the orientation of the body 200 such that the bottom surface 204 of the body 200 is parallel to the floor. In some embodiments, the body 200 may be the shape of a rectangular prism.

A top surface 202 of the body 200 may comprise a plate 255, having a handle interface 260 at a first end and wrap around the magnet cover 240 at a second end. The plate 255 may be removably affixed to the top surface 202 of the body 200 with a fastener (not shown) through an aperture 256. The handle interface 260 may be a threaded female coupler 262 that is operable to mate with a threaded male coupler 902 that is located on the bottom end of the broom handle 900. The threaded female coupler 262 on the body 200 and the threaded male coupler 902 on the broom handle 900 may comprise a plurality of complementary threads such that the threaded male coupler 902 on the broom handle 900 may thread into the threaded female coupler 262 on the body 200 to retain the body 200 on the broom handle 900. As a non-limiting example, the complementary threads may be ¾-5 ACME threads. The handle interface 260 may be oriented at a handle angle 268 towards the rear of the body 200. The handle angle 268 may be an oblique angle measured between the top surface 202 of the body 200 and the broom handle 900. In some embodiments, the handle angle 268 may be forty-five degrees to ten degrees (45°-10°; refer to FIG. 5). The plate 255 may further comprise a vertically oriented portion capable of being coupled to a front surface 206 of the body 200.

The body 200 may comprise the plurality of magnets 230. The plurality of magnets 230 may be embedded into the top surface 202 of the body 200 in a forward position such that the top of the plurality of magnets 230 are flush with the top surface 202 of the body 200 and the front of the plurality of magnets 230 are flush with the front surface 206 of the body 200. In some embodiments, the plurality of magnets 230 may be disposed on either lateral side of the plate 255. The plurality of magnets 230 may be operable to collect and retain nails or other metallic debris by rotating the invention 100 into and pulling the body 200 along the floor until the nails or other metallic debris are adjacent to the plurality of magnets 230. The nails or other metallic debris may be retained by the plurality of magnets 230 due to magnetic attraction between the nails or other metallic debris and the plurality of magnets 230 when the invention 100 is returned to the sweeping orientation 290.

In some embodiments, the body 200 may comprise a magnet cover 240. The magnet cover 240 may protect the plurality of magnets 230 from becoming contaminated by the other metallic debris. The magnet cover 240 may cover the front surface 206 and the top surface 202 of the body 200 such that the plurality of magnets 230 are located beneath the magnet cover 240. In some embodiments, the magnet cover 240 may be sheet metal that becomes magnetized by the plurality of magnets 230 located beneath the magnet cover 240. In some embodiments, the magnet cover 240 may be a non-metallic covering that the magnetic field of the plurality of magnets 230 passes through. As a non-limiting example, the magnet cover 240 may be plastic. The magnet cover 240 may be wiped clean after use to remove the nails and the other metallic debris.

In some embodiments, the magnet cover 240, the plate 255, the handle interface 260, the body 200, or combinations thereof made be fabricated from a single material. As non-limiting examples, the plate 255, the magnet cover 240, and the handle interface 260 may be a single sheet of metal that is stamped and bent to shape or the body 200 and the handle interface 260 may be a single molded plastic part.

In use, the invention 100 may be removably coupled to a threaded male coupler 902 on the bottom of a broom handle 900 to form a broom 270. While the broom 270 is in a sweeping orientation 290, a plurality of bristles 220 on the bottom of a body 200 may be pulled across a floor to sweep the floor. If a user encounters a nail or other metallic debris, the broom 270 may be moved to be adjacent to the nails or other metallic debris that have been pulled. The nails or other metallic debris may be collected and retained until removal from the plurality of magnets 230 by the user.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A broom head, comprising:

a body having a bottom surface, a top surface, a first end, and a second end;

a plurality of bristles coupled to the bottom surface of the body;

a handle interface enabling a broom handle adapted to be attached to form a broom; and a plurality of magnets located within the body to collect and retain a plurality of metallic debris and, wherein the top surface of the body includes a plate having the handle interface at the first end of the body that wraps around a magnet cover at the second end of the body;

wherein the magnet cover protects the magnets from becoming contaminated;

wherein the magnet cover covers the front surface and the top surface of the body such that the magnets are located beneath the magnet cover; and, wherein the magnets are embedded into the top surface of the body in a forward position such that the top of the magnets is flush with the top surface of the body and the front of the magnets are flush with the front surface of the body.

2. The broom head, according to claim 1, wherein the magnet cover is sheet metal that becomes magnetized by the magnets located beneath the magnet cover.

3. The broom head, according to claim 1, wherein the magnet cover is a non-metallic covering that a magnetic field of the magnets passes through.

4. The broom head, according to claim 1, wherein the magnet cover, the plate, the handle interface, the body, or combinations thereof made be fabricated from a single material.

5. The broom head, according to claim 1, wherein the plate, the magnet cover, and the handle interface is a single sheet of metal that is stamped and bent to shape or the body.

6. The broom head, according to claim 1, wherein the magnets are disposed on either lateral side of the plate.

7. The broom head, according to claim 1, wherein the handle interface is a threaded female coupler that is operable to mate with a threaded male coupler that is located on the bottom end of the broom handle.

8. The broom head, according to claim 7, wherein the threaded female coupler on the body and the threaded male coupler on the broom handle include a plurality of complementary threads such that the threaded male coupler on the broom handle threads into the threaded female coupler on the body to retain the body on the broom handle.

9. The broom head, according to claim 8, wherein the complementary threads are ¾-5 ACME threads.

10. The broom head, according to claim 1, wherein the plate is removably affixed to the top surface of the body through an aperture.

11. The broom head, according to claim 1, wherein the plate includes a vertically oriented portion coupled to a front surface of the body.

12. The broom head, according to claim 1, wherein the body is shaped like a rectangular prism.

13. The broom head, according to claim 1, wherein each of the bristles is a semi-rigid filament.

14. The broom head, according to claim 1, wherein each of the bristles are of a uniform length such that the bristles simultaneously touch a floor when the body is held in a sweeping orientation.

15. The broom head, according to claim 14, wherein the sweeping orientation refers to an orientation of the body such that the bottom surface of the body is parallel to the floor.

16. The broom head, according to claim 1, wherein the handle interface is oriented at a handle angle towards the rear of the body at an oblique angle measured between the top surface of the body and the broom handle.

* * * * *